US005735354A

United States Patent [19]

Weidner et al.

[11] Patent Number: 5,735,354

[45] Date of Patent: Apr. 7, 1998

[54] PULSE IMPACT MECHANISM, IN PARTICULAR FOR PULSE SCREWING DEVICE

[75] Inventors: Hôrst Weidner, Gaildorf; Robert Klenk, Grosserlach; Wolfgang Backe; Egbert Schneider, both of Aachen, all of Germany

[73] Assignee: Robert Bosch GmbH, Stuttgart, Germany

[21] Appl. No.: 666,547

[22] PCT Filed: Dec. 14, 1994

[86] PCT No.: PCT/DE94/01484

§ 371 Date: Sep. 16, 1996

§ 102(e) Date: Sep. 16, 1996

[87] PCT Pub. No.: WO95/17281

PCT Pub. Date: Jun. 29, 1995

[30] Foreign Application Priority Data

Dec. 21, 1993 [DE] Germany ..... 43 43 582.3

[51] Int. Cl.[6] ..... B25B 21/02

[52] U.S. Cl. ..... 173/93.5; 173/218

[58] Field of Search ..... 173/93, 93.5, 218, 173/168

[56] References Cited

U.S. PATENT DOCUMENTS 2,850,128 9/1958 Van Sittert ..... 173/93.5

2,940,566 6/1960 Conover, Jr. ..... 173/93.5

3,561,543 2/1971 Ulbring ..... 173/93.5

4,557,337 12/1985 Shibata ..... 173/93.5

*Primary Examiner*—Scott A. Smith

*Attorney, Agent, or Firm*—Michael J. Striker

[57] ABSTRACT

The pulse impact mechanism (12) has a rotation element (13), joined to a driving shaft (14), in which a receiving opening (16) for a core (17) is configured concentrically with the rotation axis (15). The core part (17) is joined in rotational engagement with a driven shaft (25). In addition, rotation element (13) has a radial bore (18), extending perpendicular to the rotation axis (15), in which a reciprocating piston (19) is received in radially displaceable fashion. The reciprocating piston (19) has a through opening (20) through which core part (17) passes. The reciprocating piston constitutes, with its inner surface facing toward the core part (17), a control surface (36) that cooperates with a control track (37), with control cam (38), configured on the core part (17). When a relative rotation of rotation element (13) and core part (17) occurs, the reciprocating piston (19) executes a stroke in the radial direction. Pressure is thereby applied to a pressure medium located in a pressure chamber (40), a rotary pulse being transferred via the control surface (36) and the control track (37) to the driven shaft (25).

10 Claims, 5 Drawing Sheets

PULSE IMPACT MECHANISM, IN PARTICULAR FOR PULSE SCREWING DEVICE

BACKGROUND OF THE INVENTION

The invention is based on a pulse impact mechanism of the type defined in claim 1. A pulse impact mechanism is already known (EP 460 592 A1) in which rotary pulses are generated by means of radially outwardly directed and radially movable spring-loaded plates that at least temporarily separate high-pressure spaces and adjacent low-pressure spaces sealingly from one another. The plates have specially shaped sealing surfaces on their exterior that, in order to prevent leakage losses, must be produced as accurately as possible, which requires a relatively high level of production engineering complexity.

SUMMARY OF THE INVENTION

The pulse impact mechanism according to the invention has, on the other hand, the advantage of having substantially simpler and more accurately manufacturable rotationally symmetrical sealing surfaces, so that production-related dimensional and/or geometrical deviations, and the leakage losses that go along with them, can be reduced. A compact construction in the axial direction can be achieved by configuring the pulse impact mechanism with at least one reciprocating piston acting in the radial direction.

Advantageous developments and improvements of the pulse impact mechanism are made possible by means of additional features.

BRIEF DESCRIPTION OF THE DRAWINGS

Exemplified embodiments of the invention are depicted in the drawings and explained in greater detail in the description which follows. In the drawings.

DESCRIPTION OF THE PREFERRED EMBODIMENTS

Figure 1:
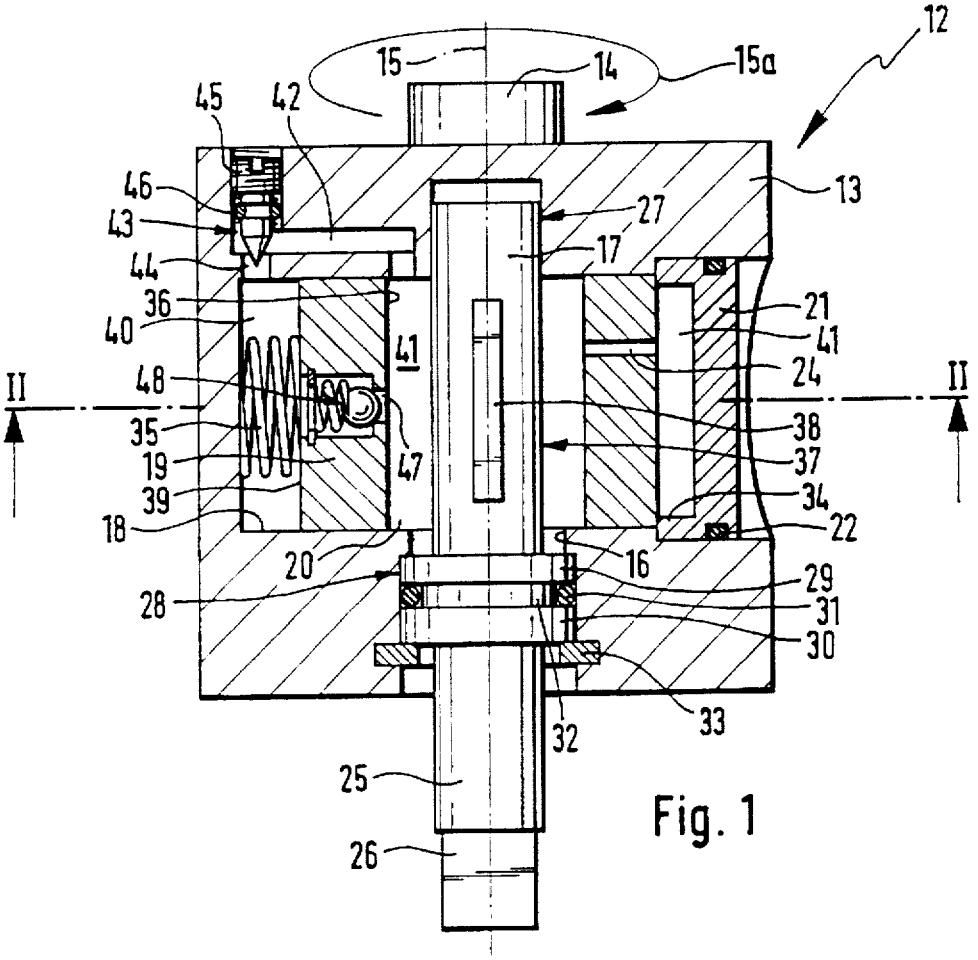
FIG. 1 shows a longitudinal section of a first exemplified embodiment of a pulse impact mechanism configured in accordance with the invention.

The pulse impact mechanism depicted in FIG. 1 has a cylindrical rotation element 13 that can be driven rotatably, via a driving shaft 14 by means of a drive motor (not depicted further), about a rotation axis 15, for example in the direction of an arrow 15*a*. Rotation element 13 has at its end facing away from driving shaft 14 a central receiving opening 16, passing almost completely through rotation element 13, in which a cylindrical core part 17 is concentrically arranged. Located perpendicular to rotation axis 15, approximately centered in rotation element 13, is a radial bore 18 in which a reciprocating piston 19 is received in radially displaceable fashion. Located in reciprocating piston 19 is a through opening 20 that extends perpendicular to the stroke direction of reciprocating piston 19 in the axial direction, and in which core part 17 projects through reciprocating piston 19 with clearance. Radial bore 18 can be closed off with a cover 21, and sealed off from the outside by means of suitable sealing means 22.

Core part 17 is coupled in rotary engagement with a driven shaft 25 that is equipped at the end with an attachment device for a screw tool, for example for a screwing device bit. In this example, core part 17 and driven shaft 25 are joined integrally together. Core part 17 is configured at the end of driven shaft 25. Core part 17 and driven shaft 25 are mounted in receiving opening 16 rotatably in the circumferential direction with respect to rotation element 13. In the exemplified embodiment, mounting occurs in bearing seats 27 and 28, each alongside radial bore 18. A bearing seat 28 located closer to attachment device 26 is constituted by two annular collars 29 and 20, arranged at an axial offset from one another, of core part 17, between which a sealing ring 31, which seals receiving opening 16 from the outside, sits in an annular groove 32. Core part 17 is fixed in the axial direction inside rotation element 13 by a retaining ring 33.

Reciprocating piston 19 has spring force applied to it in the direction of cover 21 by a return spring 35, and is held pressed against a stop 34 projecting radially inward on cover 21. Reciprocating piston 19 forms, inside through opening 20, a circumferential control surface 36 acting as control means, which cooperates with a control track 37 arranged on core part 17 in the region of radial bore 18. In the exemplified embodiment, control track 37 has an almost cylindrical cross section with a radially protruding, bar-shaped control cam 38.

Cavities remaining inside rotation element 13 are filled almost completely with a substantially incompressible pressure medium, for example a hydraulic oil. Reciprocating piston 19 separates a pressure chamber 40, located at the bottom of radial bore 18, from a low-pressure space 41. Low-pressure space 41 extends substantially over two subregions, inside through opening 20 between core part 17 and rotation element 13, and between reciprocating piston 19 and cover 21. The two subregions are interconnected via an equalization passage 24. The piston surface of reciprocating piston 19 facing toward pressure chamber 40 constitutes a working surface 39.

Pressure chamber 40 is interconnected with low-pressure space 41 via a first connecting passage 42 extending in rotation element 13. Arranged in first connecting passage 42 is an adjustable control valve 43 with which an overflow cross section 44 to first connecting passage 42 can be controlled. Control valve 43 consists, for example, of an axially displaceable set screw 45 with a conical tip. A seal 46 arranged on the outer periphery of set screw 45 prevents pressure medium from escaping outward past set screw 45.

A second connecting passage 47 is configured in reciprocating piston 19 between low-pressure space 41 and pressure chamber 40. Second connecting passage 47 extends radially from control surface 36 to working surface 39 of reciprocating piston 19. Arranged in second connecting passage 50 is a backflow valve 48 that blocks flow toward low-pressure space 41 when pressure is present in pressure chamber 40, and in the reverse direction, when a corresponding negative pressure is present in pressure chamber 40, allows pressure medium to flow back. It is evident from FIG. 2 that backflow valve 48 is configured as a non-return valve, and has a spherical valve closure element 49 to which spring force in the direction of low-pressure space 41 is applied by a valve closure spring 50. Valve closure spring 50 is braced against a support ring 51 joined immovably to the reciprocating piston.

Figure 2:
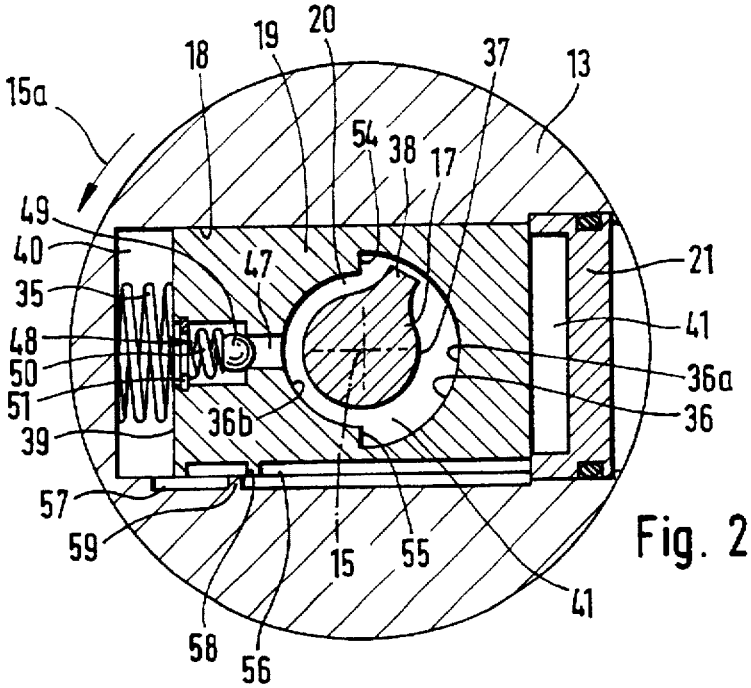
FIG. 2 shows a cross section along line II—II in FIG. 1.

The cylindrical construction of rotation element 13 is apparent in FIG. 2. Reciprocating piston 19, also rotationally symmetrical, is arranged in radial bore 18. Through opening 20, through which core part 17 projects, is located centrally in reciprocating piston 19. In FIG. 2 core part 17 is rotated approximately 30°, opposite to arrow direction 15a, from the position shown in FIG. 1. Control surface 36 is composed of two partial surfaces 36a, 26b, each approximately semicircular in shape. First partial surface 36a, located closer to cover 21, has a greater radial spacing from rotation axis 15 than second partial surface 36b opposite it, located closer to pressure chamber 40. The radial spacing of second partial surface 36b from rotation axis 15 is less than the radial spacing of control cam 38. Approximately perpendicular to rotation axis 15 and to the stroke direction of reciprocating piston 19, partial surfaces 36a and 36b are joined to one another by means of step surfaces 54 and 55 extending approximately radially.

When pulse impact mechanism 12 is idling, core part 17 rotates along with rotation element 13 due to frictional effects. When the torque acting on attachment device 26 during a screwing operation exceeds the frictional torque, rotation element 13 is rotated with respect to core part 17. Core part 17 then rotates more slowly than rotation element 13.

If a relative rotation of rotation element 13 and core part 17 occurs starting from the position shown, for example by the fact that rotation element 13 continues to rotate in arrow direction 15a with respect to core part 17, control cam 28 of core part 17 ultimately comes into contact against step surface 55. Depending on the magnitude of the effective torque, reciprocating piston 19 is then displaced against the force of return spring 35, reducing the volume of pressure chamber 40, and a rotary pulse is thereby exerted on attachment device 26. Having passed beyond step surface 55, control cam 38 can slide along second partial surface 36b until, after a further half relative rotation after passing along second partial surface 36b, it again releases reciprocating piston 19. Reciprocating piston 19 is then brought back, by return spring 35, out of its stroke position into contact against stop 34. After completing the further half relative displacement, control cam 38 again comes into contact against step surface 55 in order to generate a further rotary pulse. Because of the symmetrical configuration of control surface 36 and control track 37, pulse impact mechanism 12 can also be operated in the reverse drive direction.

During the reduction in volume of pressure chamber 40, a pressure is exerted on the pressure medium by working surface 39. Pressure medium can initially reach low-pressure space 41 via overflow grooves 56 arranged on the outer surface of reciprocating piston 19 and via corresponding recesses, opposite the latter, in rotation element 13 in the region of radial bore 18. Overflow groove 56 and recess 57 together constitute an overflow conduit from pressure chamber 40 to low-pressure space 41. Axially extending sealing bars 58, 59, which become congruent with one another as the stroke of reciprocating piston 19 increases, are arranged in overflow groove 56 and inside recess 57. When this occurs, pressure chamber 40 is abruptly sealed. Depending on the size of the adjustable overflow cross section at control valve 43, a pressure resistance of greater or lesser magnitude then acts on reciprocating piston 19. Non-return valve 48 then blocks flow. The overflow cross section must be selected so as to prevent pulse impact mechanism 12 from locking up. When an elevated pressure resistance is effective in pressure chamber 40, a correspondingly strong rotary pulse is transferred via control surface 36 and control cam 38 to core part 13.

Because of the relatively large inertial mass of rotation element 13 and the drive train coupled to it, relatively large rotary pulses can be achieved without locking up pulse impact device 12. When the volume of pressure chamber 40 subsequently increases after partial surface 36b has been passed over, pressure medium can flow back via backflow valve 48 into pressure chamber 40 due to the resulting negative pressure.

Figure 3:
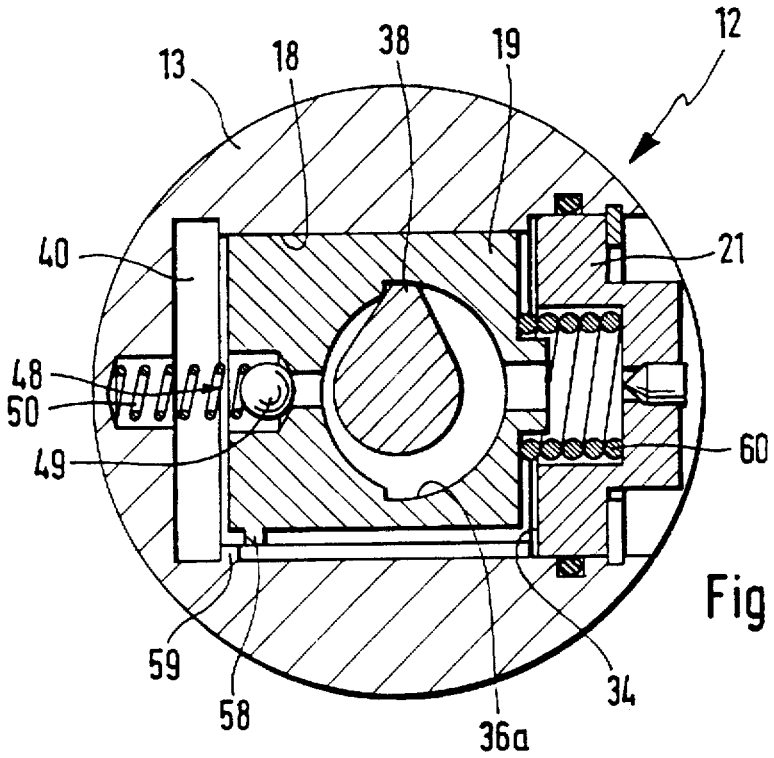
FIGS. 3 and 4 each show cross sections through two further exemplified embodiments of a pulse impact mechanism.

FIG. 3 depicts a second exemplified embodiment of pulse impact device 12. Parts that are the same, or operate in the same way, as those of the first exemplified embodiment according to FIGS. 1 and 2 are identified by the same reference characters. Here again, a single reciprocating piston 19 is received in radial bore 18. The main difference from the first exemplified embodiment is the arrangement of a damping spring 60 between reciprocating piston 19 and cover 21. Damping spring 60 is configured as a compression spring. The purpose of damping spring 60 is to prevent or damp any impact of reciprocating piston 19 against step 34. In addition, damping spring 60 helps control cam 38 pass along partial surface 36b without jamming. The radius of first partial surface 36a of control surface 36 corresponds approximately to that of control cam 38. Damping spring 60 acts on reciprocating piston 19 in the direction of pressure chamber 40, causing control cam 38 and first partial surface 36a to contact one another.

In this case reciprocating piston 19 is automatically returned, from the stroke position into the starting position shown, by the pressurized pressure medium in pressure chamber 40, and the return process is supported by the passage of control cam 38 along first partial surface 36a. The return spring can therefore be omitted. In this embodiment valve closure spring 50 of backflow valve 48 is braced against the bottom of radial bore 18. In the initial position shown, sealing bars 58, 59 are spaced a short distance from one another, so that a short stroke is sufficient to close pressure chamber 40.

Figure 4:
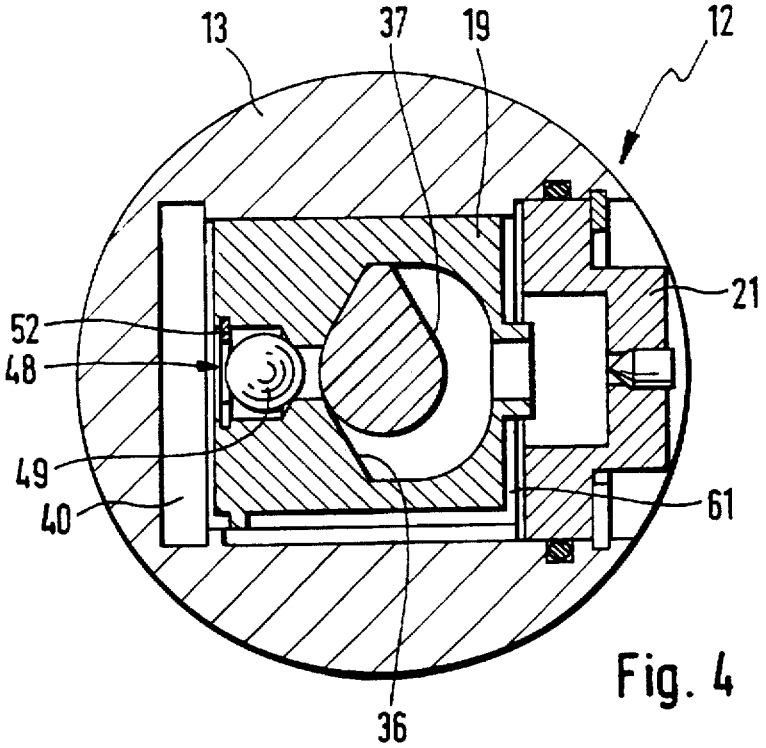

FIG. 4 depicts a third exemplified embodiment of pulse impact mechanism 12. Parts that are the same, or operate in the same way, as those of the first or second exemplified embodiment are again identified by the same reference characters. Here again, no additional return spring 35 for reciprocating piston 19 is present, since return is accomplished by means of first partial surface 36a. In contrast to the preceding exemplified embodiments, control surface 36 is configured without step surfaces. While first partial surface 36a has approximately the same radius as control cam 38, second partial surface 36b extends with a different radius that, in the circumferential direction of control cam 38 and proceeding from the radius of control cam 38, transitions into a radius corresponding to the radius of core part 17, and then back into the radius of control cam 38. Second partial surface 36b has a curved profile that is highly adapted to the outer periphery of core part 17, so that in the initial position shown, reciprocating piston 19 is in contact with control track 37 over a large area.

Control track 37 thus constitutes a stop for second partial surface 36b during the return stroke of reciprocating piston 19. In the initial position, a gap 61 is present between reciprocating piston 19 and cover 21, so that a damping spring to absorb return impact against cover 21 can be omitted. A valve closure spring is also not needed here, since valve closure element 49 is closed by the pressure of the pressure medium in pressure chamber 40. A retaining ring 52 prevents valve closure element 49 from moving out into pressure chamber 40.

Figure 5:
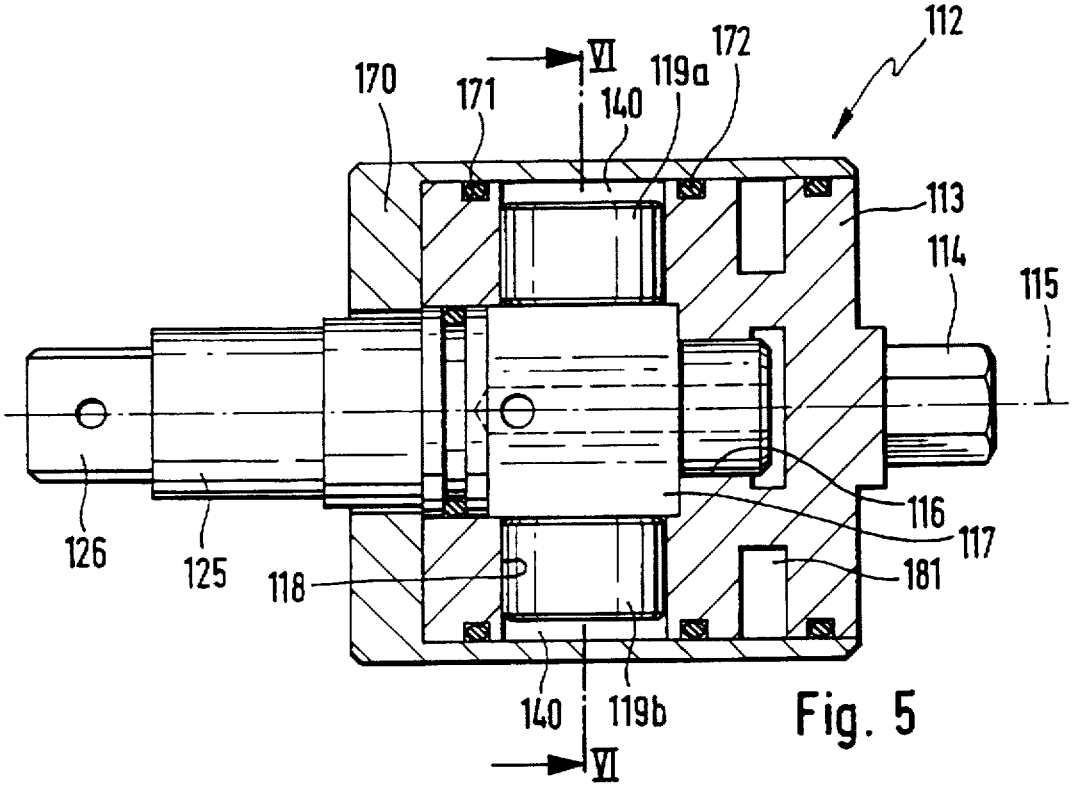
FIGS. 5, 6, and 7 show a fourth exemplified embodiment.
Figure 6:
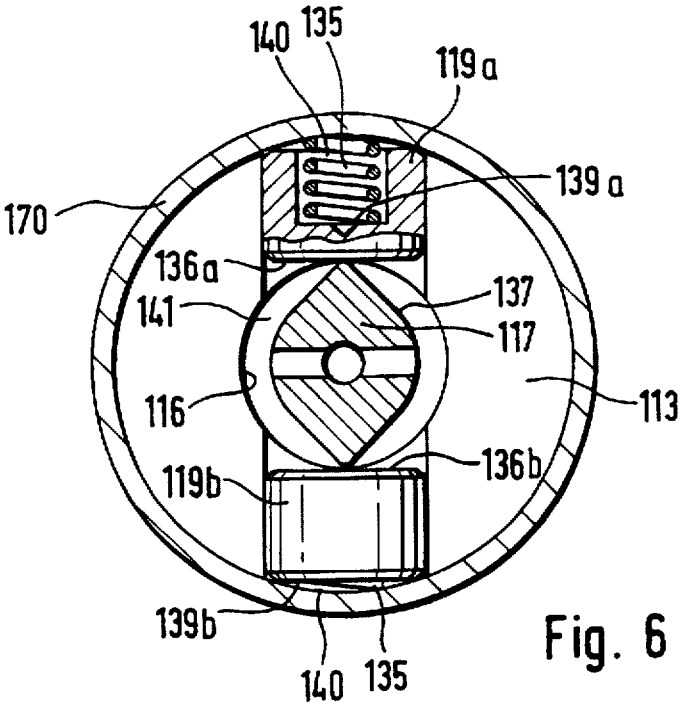
Figure 7:
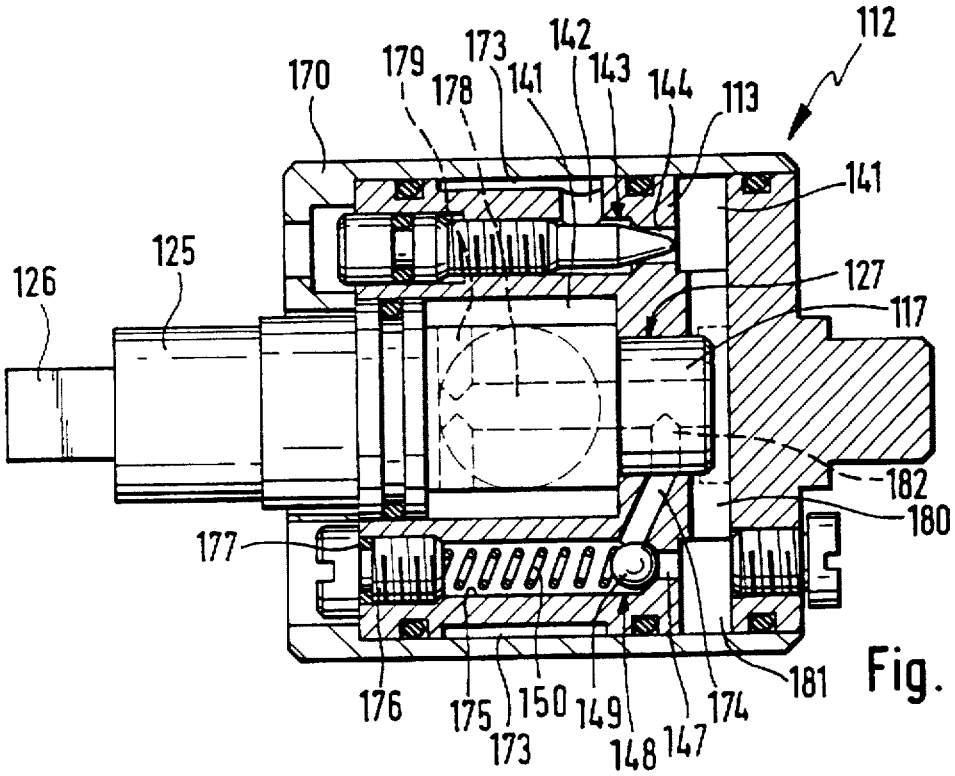

FIGS. 5, 6, and 7 depict a fourth exemplified embodiment. In contrast to the foregoing exemplified embodiments, in this and the two following embodiments two reciprocating pistons are arranged in the radial bore. Parts that are the same, or operate in the same way, as those of the foregoing embodiments are identified, in all the following embodiments with two pistons, by a reference character to which 100 has been added.

A cylindrical rotation element 113 can be driven rotatably about a rotation axis 115 via a driving shaft 114. Arranged inside an axial receiving opening 116 is a core part 117 that is joined, in rotary engagement and axial alignment, to a driven shaft 125. Driven shaft 125 bears at one end an attachment device 126 for sliding on a rotary tool. A pass-through radial bore 118 is configured in rotation element 113. Two reciprocating pistons 119*a*, 119*b* are received in radial bore 118. Radial bore is closed off from the outside at both ends by a cup-shaped housing 170. Sealing means 171, 172 are provided between rotation element 113 and housing part 170. Housing part 170 and rotation element [113] are nonrotatably joined to one another. Reciprocating pistons 119 separate a radially externally located pressure chamber 140 from a low-pressure chamber 141. Extending from low-pressure space 141 is a circumferential annular chamber 181 arranged in rotation element 113 at an axial offset from radial bore 118.

As is evident from FIG. 6, core part 117 has approximately a double-arc, mirror-symmetrical cross section. Each are section of control track 137 has a continuous transition from a large radial spacing from rotation axis 115, through a small radial spacing, to a correspondingly large radial spacing. Control surfaces 136*a*, 136*b* configured on reciprocating piston 119, which correspond to control track 138 and act as control means, are flat in configuration. Located on radially external working surfaces 139*a*, 139*b* of reciprocating pistons 119*a*, 119*b* are receiving bores 169 for return springs 135, which are braced at one end against reciprocating pistons 119 and at the other end against housing part 170. In FIG. 6, the reciprocating pistons are each depicted in the stroke position at the radially outer reversing point. Upon further rotation of rotation element 113 with respect to core part 117, reciprocating pistons 119 can move radially back inward along control track 137.

In FIG. 7, pulse impact mechanism 112 of FIG. 5 has been rotated 90° into the plane of the drawing. This shows that an annular groove extending around in the circumferential direction, which interconnects the high-pressure spaces 140 delimited by reciprocating pistons 119, is arranged between housing part 170 and rotation element 113 on the outer periphery of rotation element 113. The pressure medium, which is pressurized during the radially outward stroke, can flow through a first connecting passage 142, with control valve 143 arranged therein, to annular chamber 181 of low-pressure space 141. Control valve 143 is arranged in an axial threaded hole in rotation element 113. First connecting passage 142 first extends radially inward from annular groove 173 to control valve 143, and then axially to annular chamber 181.

A bore 174 extending radially obliquely inward to shaft bearing 127 extends in the sectioned half that is offset 180° from control valve 143. Bore 174 is intersected by an axial bore 175 that penetrates completely through rotation element 113. The driven end of axial bore 175 is sealed by means of a threaded cap 176 and associated sealing means 177. The driving-side part of additional bore 175 opens into annular chamber 181 of low-pressure space 141. The axial region between bore 174 and low-pressure space 141 of additional bore 175 constitutes a second connecting passage 147 in which a backflow valve 148 is arranged. An associated valve closure spring 149 of backflow valve 148 is braced at one end against threaded cap 176, and at the other end against valve closure element 149.

Located in core part 117 is an axial conduit 178 that communicates via a continuous radial conduit 179 with the portion of low pressure space 141 located between control surfaces 136 and control track 137. In the axial direction, conduit 178 passes through core part 117 to its driving-side end. It is connected there to annular chamber 181 via a radially continuous transverse conduit 180 in rotation element 113. Located in core part 117 in the region of shaft bearing 127 is a control bore 182, open at one end, to conduit 178, which becomes congruent with the opening of bore 174 once for each complete rotation of core part 117 with respect to rotation element 113. Pressure chamber 140 is then connected, via bore 174, control bore 182, and conduit 178, to low-pressure space 141, so that no appreciable pressure builds up in pressure chamber 140. Upon a further 180° rotation, after which reciprocating pistons 119*a*, 119*b* are also in their outer stroke position, the connection between bore 174 and control bore 182 is interrupted, so that pressure can then build up in pressure chamber 140. The result is that a pulse occurs only once for each relative rotation of rotation element 113 and core part 117, so that greater inertial energy can be built up between the individual pulses.

Figure 8:
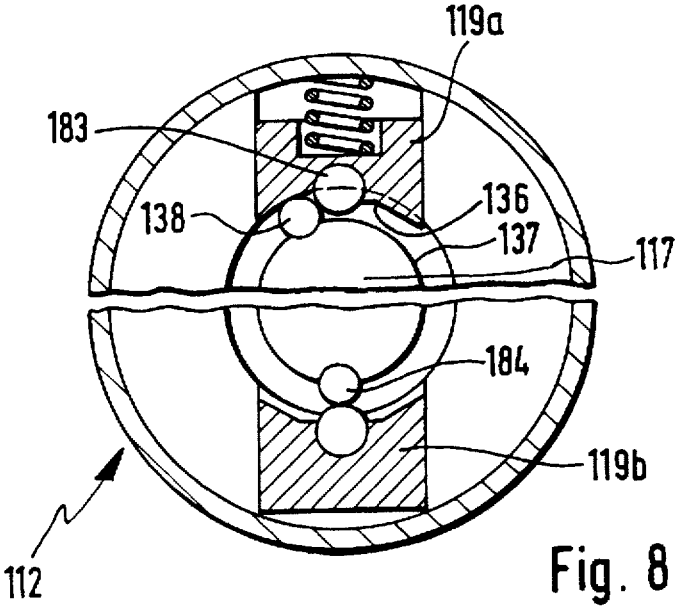
FIG. 8 shows a cross section through a fifth exemplified embodiment.

FIG. 8 shows a fifth exemplified embodiment in which the surfaces at which reciprocating pistons 119*a*, 119*b* contact control track 137 are modified as compared with the exemplified embodiment according to FIGS. 5, 6, and 7. In this case control track 137 of core part 117 is of predominantly cylindrical configuration. Two control cams 138 are arranged on the outer periphery of core part 117, offset 180° (not depicted) from one another. Control cams 138 consist, for example, of rolling elements 184 that are retained on core part 177 immovably in the circumferential direction, but rotatably about their longitudinal axis. Control cams 138 cooperate with rollers 183, mounted into control surfaces 136 of reciprocating pistons 119 and correspondingly offset 180°, which act as control means in place of control surfaces 136. The frictional forces between control track 137 and control surface 136 can thereby be reduced. Pulse impact mechanism 112 is shown in its initial position in the upper half of FIG. 8, and in its outer stroke position in the lower half. To reduce frictional resistance, rolling elements 183, 184 can also be provided in control surfaces 36, 136 and/or control tracks 37, 137 in the other embodiments of pulse impact mechanism 12, 112. In particular, control cam 38 of pulse impact mechanism 12 can be configured as a rolling element.

Figure 9:
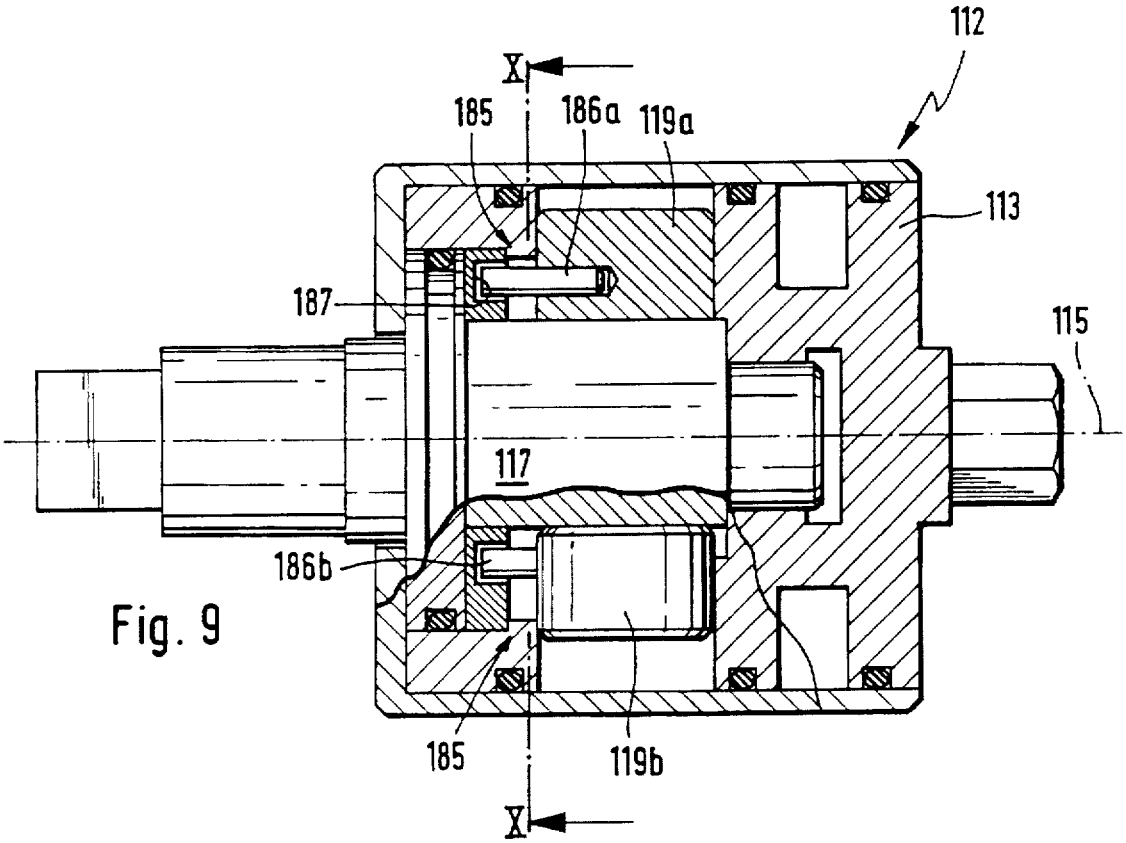
FIG. 9 shows a longitudinal section through a sixth exemplified embodiment.
Figure 10:
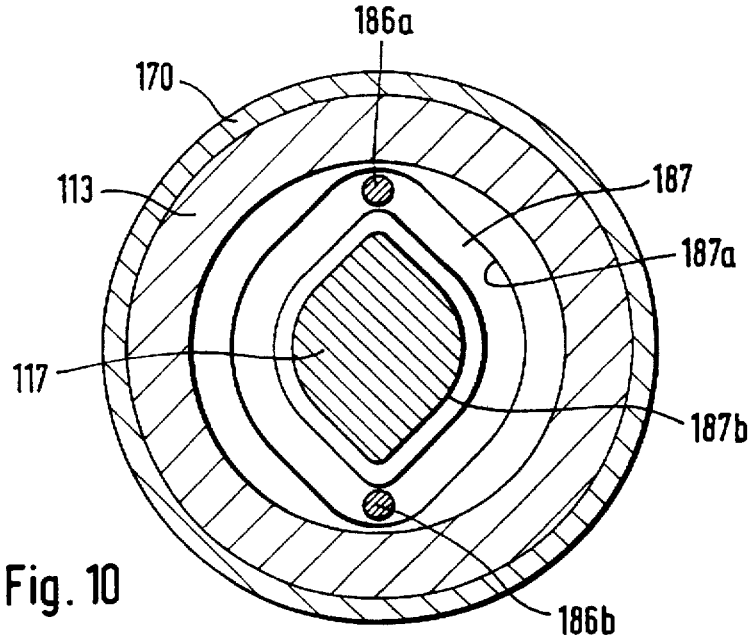
FIG. 10 shows a cross section along line X—X in FIG. 9.

FIGS. 9 and 10 depict a further exemplified embodiment of pulse impact mechanism 112 in which reciprocating pistons 119*a*, 119*b* are moved in the stroke direction by a positive control system 185. Retained in the driven-end side wall of reciprocating piston 119 are cylindrical pins 186*a*, 186*b* which engage into a control groove 187 extending around core part 117. In the circumferential direction of core part 117, control groove 187 has a variable radial spacing from rotation axis 115, so that the stroke position of reciprocating pistons 119*a*, 119*b* is modified depending on the angular rotation position between rotation element 113 and core part 117. Control groove 187 has a symmetrical profile, so that the two reciprocating pistons 119 each reach their outer and inner stroke positions simultaneously. The upper half of FIG. 9 shows the radially outer stroke position of reciprocating piston 119*a*; the lower half shows the radially inner stroke position of reciprocating piston 119*b*, offset 90° from it.

FIG. 10 depicts control groove 187 in section. It has an approximately double-arc profile, corresponding to control track 137 in FIG. 6. The two cylindrical pins 186 engage into control groove 187. The reciprocating pistons are moved inward from their radially outer position by means of groove wall 187*a* located radially farther outward. They are correspondingly moved outward by inner side wall 187*b*. In the embodiment with positive control device 185, return springs for reciprocating pistons 119*a*, 119*b* are not necessary.

In the exemplified embodiments according to FIGS. 8 to 10, the high-pressure space or pressure chamber, and the low-pressure space and annular chamber as extension, are configured generally in accordance with the example of FIGS. 5 to 7. The allocation of driving shaft 14 to rotation element 13, and of driven shaft 25 to core part 17, as described in the exemplified embodiments, is not mandatory, but it is advantageous due to the higher geometrical moment of inertia of rotation element 13, and the consequently greater inertial mass of the drive.

We claim:

1. A pulse impact mechanism, in particular for pulse screwing device comprising a rotation element (13, 113), rotatable about a rotation axis (15, 115) of the pulse impact mechanism (12, 112), that has an axially extending central receiving opening (16, 116); and a core part (17, 117), leading to a side, that is arranged rotatably relative to the rotation element (13, 113) inside the receiving opening (16, 116), the rotation element (13, 113) has at least one radial bore (18, 118), extending perpendicular to the rotation axis (15, 115), in which at least one reciprocating piston (19, 119*a*, 119*b*) is received in radially displaceable fashion, the at least one said reciprocating piston (18, 119*a*, 119*b*) is received in radially displaceable fashion, the at least one said reciprocating piston (19, 119*a*, 119*b*) having a working surface (39, 139) at an end and control means (36, 136) located in a region of the core part (17, 117), the control means (36, 136) cooperating with at least one circumferential control track (37, 137), connected to the core part (17, 117), the at least one control track (37, 137) has in the circumferential direction of the core part (17, 117) an alternating radial spacing from the rotation axis (15, 115) to generate a radial displacement of the reciprocating piston (19, 119*a*, 119*b*) so that pressure can be applied via the working surface (39, 139) to a pressure medium located in a pressure chamber (40, 140).

2. The pulse impact mechanism as defined in claim 1, wherein the rotation element (13, 113) is joined in rotational engagement with a driving shaft (14, 114), and the core part (17, 117) is joined in rotational engagement with a driven shaft (25, 125), of the pulse impact mechanism (12, 112).

3. The pulse impact mechanism as defined in claim 1 wherein the pressure chamber (40, 140) is connected via a first connecting passage (42, 142) to a low-pressure space (41, 141), a control valve (43, 143), by means of which an overflow cross section (44, 144) in the first connecting passage (42, 142) can be adjusted, being arranged in the first connecting passage (42, 142).

4. The pulse impact mechanism as defined in claim 1, wherein the pressure chamber (40, 140) is connected via a second connecting passage (47, 147) to a low-pressure space (41, 141), a backflow valve (41, 141) being arranged in the second connecting passage (47, 147).

5. The pulse impact mechanism as defined in claim 1, wherein at least one rolling element (183) is arranged as control means (36, 136) in a control surface of the reciprocating piston (19, 119*a*, 119*b*), and at least one further rolling element (184), optionally cooperating therewith, is arranged in the control track (37, 137) of the core part (17, 117).

6. The pulse impact mechanism as defined in claim 1, wherein the at least one reciprocating piston (19, 119*a*, 119*b*) is positively controlled in the radial direction as the core part (17, 117) rotates relative to the rotation element (13, 113).

7. The pulse impact mechanism as defined in claim 1, wherein the rotation element 913) has a radial bore (18), open at one end and closable by means of a cover (21), in which a single reciprocating piston (19) is arranged in radially displaceable fashion.

8. The pulse impact mechanism as defined in claim 1, wherein the control track (137) has two radial elevations (138) located opposite one another that are connected, via an arc-shaped section with a small radial spacing from the rotation axis (115), to the respective other elevation (138).

9. The pulse impact mechanism as defined in claim 1 wherein a conduit (178) with control bore (182), connected to the low-pressure space (141), which becomes congruent with a bore (174) connected to the pressure chamber (141) once for each complete relative rotation of core part (117) and rotation element (113), is arranged in the core part (117).

10. A pulse impact mechanism, in particular for pulse screwing device comprising a rotation element (13, 113), rotatable about a rotation axis (15, 115) of the pulse impact mechanism (12, 112), that has an axially extending central receiving opening (16, 116), and a core part (17, 117), leading to a side that is arranged rotatably relative to the rotation element (13, 113) inside the receiving opening (16, 116), the rotation element (13, 113) has at least one radial bore (18, 118), extending perpendicular to the rotation axis (15, 115), in which at least one reciprocating piston (19, 119*a*, 119*b*) is received in radially displaceable fashion, the at least one said reciprocating piston (18, 119*a*, 119*b*) is received in radially displaceable fashion, the at least one said reciprocating piston (19, 119*a*, 119*b*) having a working surface (39, 139) at an end and control means (36, 136) located in a region of the core part (17, 117), the control means (36, 136) cooperating with at least one circumferential control track (37, 137), connected to the core part (17, 117), the at least one control track (37, 137) has in the circumferential direction of the core part (17, 117) an alternating radial spacing from the rotation axis (15, 115) to generate a radial displacement of the reciprocating piston (19, 119*a*, 119*b*) so that pressure can be applied via the working surface (39, 139) to a pressure medium located in a pressure chamber (40, 140), the at least one radial bore (18, 118) is a pass-through radial bore (118) closed off by a hollow cylindrical housing part (170), and two such reciprocating pistons (19*a*, 19*b*) are provided and guided in the pass-through radial bore (118) in radially displaceable fashion.

* * * * *